US005398914A

United States Patent [19]

Gay

[11] Patent Number: 5,398,914

[45] Date of Patent: Mar. 21, 1995

[54] MOLTEN SALT PROCESS VESSEL

[75] Inventor: Richard L. Gay, Chatsworth, Calif.

[73] Assignee: Rockwell International Corporation, Seal Beach, Calif.

[21] Appl. No.: 126,851

[22] Filed: Sep. 27, 1993

[51] Int. Cl.[6] ..... C10G 9/26

[52] U.S. Cl. ..... 266/197; 266/200; 208/125; 588/900

[58] Field of Search ..... 266/200, 120, 153, 197; 423/648.1, 580.1; 110/346; 588/900, 201, 202, 203; 422/205, 186, 187; 48/119, 123, 89, 127.9; 208/125

[56] References Cited

U.S. PATENT DOCUMENTS

| | | | |
|---|---|---|---|
| 2,055,313 | 9/1936 | Ruthruff | 208/125 |
| 2,358,912 | 9/1944 | Dimmig | 208/125 |
| 4,133,517 | 1/1979 | Esdaile et al. | 266/200 |
| 4,421,631 | 12/1983 | Ampaya et al. | 208/125 |

*Primary Examiner*—Scott Kastler

*Attorney, Agent, or Firm*—H. Fredrick Hamann; Harry B. Field; Steven E. Kahm

[57] ABSTRACT

A molten salt process vessel for treatment of hazardous materials such as explosive or propellant waste, employing a tall, thin vessel with sufficient height that salt splash from the molten salt at the bottom of the vessel can be controlled and hard salt deposits are prevented from forming on the walls which restrict the gas outlet. The vessel, e.g. of cylindrical shape, has an increased height to diameter ratio in the range of about 7:1 to about 12:1, to give additional clearance. As an additional feature the vessel diameter can also be adjusted to create a "necked-down" region just below the gas outlet duct adjacent the top of the vessel to increase product gas velocity of the gas containing entrained salt particles, to prevent sticking of such particles to the vessel walls and restricting the gas outlet duct. A further feature of the invention is the provision of baffles located just above the body of molten salt in the region where temperature is at or above the salt melting point, inhibiting salt splash to the top of the vessel, and permitting molten salt particles striking the baffles to drain back to the body of molten salt.

8 Claims, 1 Drawing Sheet

MOLTEN SALT PROCESS VESSEL

BACKGROUND OF THE INVENTION

1. Field of the Invention

This invention relates to the destruction of hazardous materials, such as propellants and explosives in a molten salt medium, and is particularly directed to an improved molten salt vessel for this purpose, which substantially minimizes splashing of molten salt adjacent the top of the vessel and resultant formation of hard deposits on the walls of the vessel.

2. Description of the Prior Art

Hazardous material such as propellants and explosives require disposal of these materials as a waste, safely. The use of a molten salt bath containing, for example, alkali metal carbonate, as a medium for oxidation and destruction of such hazardous waste materials has been developed. However, during molten salt treatment of such hazardous waste materials, salt from the molten salt bath can be splashed on the walls of the vessel adjacent the top thereof, causing hard deposits to form which restrict passage of reaction gas to the gas outlet.

Previous designs of molten salt process vessels have employed a height to diameter ratio which has been found to be insufficient because it results in obtaining a significant amount of salt splashing adjacent the top of the vessel and freezing. Also, frozen solid particles of salt entrained in the product gas are carried up to the product gas outlet ducting and freeze adjacent the connection of the ducting and the process vessel. The frozen particles then adhere to the walls of the vessel at the top thereof. As these deposits build up they form a constriction adjacent the top of the vessel. Such constriction is just below the location where the process gas leaves the vessel and goes into the off-gas ducting.

In U.S. Pat. 4,421,631, of Ampaya, et al, an elongated reactor is employed for treatment of hydrocarbons utilizing a molten salt, so that several separate reactions in separate reaction zones can occur along the length of the reactor.

SUMMARY OF THE INVENTION

It has been found according to the invention that salt splash buildup in molten salt process vessels having a single reaction zone for treatment of hazardous material such as explosives and propellants can be substantially reduced by employing an elongated or tall, thin vessel, with sufficient height that salt splash from the body of molten salt in the single reaction zone at the bottom of the vessel can be controlled and salt deposits can be melted back into the body of the molten bath in the vessel. Also, the additional height of the process vessel will permit freezing of the salt particles before leaving the molten salt vessel.

It has now been found that if the height to diameter or width ratio of the molten salt vessel is increased to at least about 7:1, the height being measured from the bottom of the vessel to the product gas outlet duct, sufficient additional clearance is provided at the top of the vessel to substantially avoid freezing and buildup of deposition of solid salt particles on the top walls of the process vessel adjacent the outlet gas ducting.

As an additional feature of the invention, the vessel diameter can also be adjusted preferably adjacent the top to create a "necked-down" region followed by a wider diameter region so as to increase the velocity of the product gas and any entrained particles therein through such "necked-down" region, thus aiding in preventing impingement and sticking of such solid particles on the vessel walls.

Yet another feature of the invention is the provision of internal baffles located above the body of the salt bath but in the region of the salt melting point, which inhibits splash of molten salt to the top of the vessel so that when the molten salt particles impinge on the baffles such particles drip back down into the molten salt bath.

OBJECTS OF THE INVENTION

It is accordingly an object of the present invention to provide an improved molten salt process vessel for treatment of hazardous materials such as propellants or explosives so as to prevent salt splashing upwardly within the vessel from freezing and forming hard deposits on the walls of the vessel, particularly adjacent the upper portion thereof.

Another object is the provision of an improved molten salt process vessel of the above type having means to prevent or reduce deposition of salt particles carried up from the salt bath on the walls adjacent the top of the vessel and restricting flow of the product gas to the product gas outlet duct.

Yet another object is the provision of means above the body of molten salt and in the region of the salt melting point, for inhibiting splash of molten salt particles to the top of the vessel and returning such salt particles to the body of molten salt.

Other objects and advantages of the invention will be apparent or made obvious by the description below of certain preferred embodiments of the invention.

DETAILED DESCRIPTION OF PREFERRED EMBODIMENTS OF THE INVENTION

Figure 1:
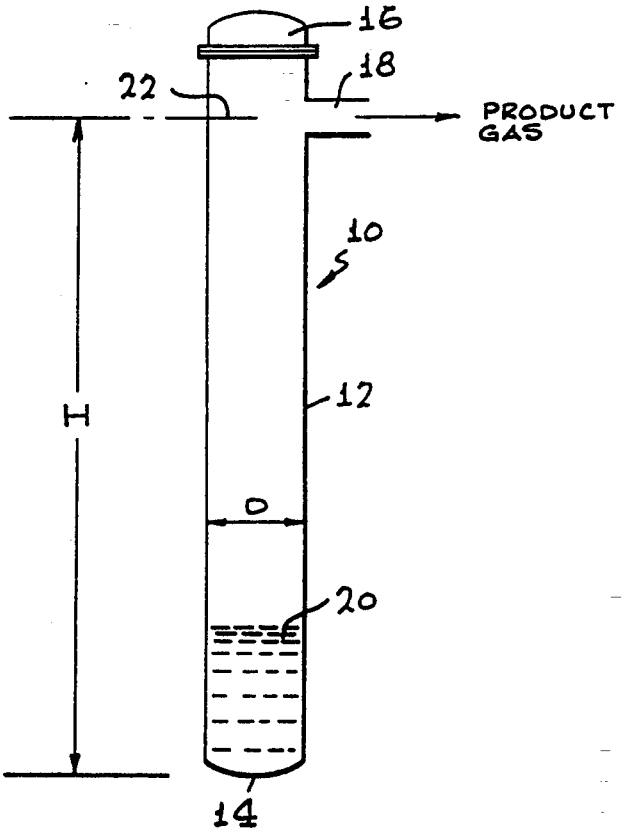
FIG. 1 of the drawing is a schematic illustration of a molten salt process vessel according to the invention.

Referring to FIG. 1, there is illustrated a molten salt process vessel indicated at 10 for treatment of hazardous materials such as propellants or explosives by oxidation in a molten salt medium, comprising an elongated cylindrical vessel 12 closed at the bottom 14 and closed at the top by a flange cover 16, and having a laterally extending product gas outlet or duct 18 adjacent the upper end of the vessel.

The elongated molten salt treatment vessel 12 has as an essential feature a height/diameter or height/width ratio of at least 7:1, and generally in the range of about 7:1 to about 12:1.

The molten salt bath 20 contained in the bottom of the treatment vessel and into which the propellant or explosive waste material is introduced, can be of any known composition serving as a medium for treatment, i.e. oxidation, of the hazardous waste. Thus, such molten salt bath can contain an alkali metal carbonate such as sodium carbonate, potassium carbonate or lithium carbonate, or mixtures thereof. Representative molten salt baths can contain 50% sodium carbonate and 50% potassium carbonate, by weight, or a lithium carbonate—sodium carbonate mixture containing 42 mol % lithium carbonate and 58 mol % sodium carbonate. Also, mixtures of sodium carbonate and alkali metal hydroxide such as sodium hydroxide, can be employed. Mixtures of sodium carbonate, sodium sulfate and sodium chloride, and also mixtures of calcium chloride, calcium oxide and calcium sulfate can be utilized. Temperature of the molten salt bath 20 can be maintained from about 300° to about 1100° C., preferably about 700° to about 900° C., by incorporating the molten salt process vessel 10, e.g. within an electric furnace (not shown).

For carrying out the decomposition or oxidation of, for example explosive or propellant waste material in the salt bath 20, such waste material is introduced into the molten salt bath and process air (not shown) is also introduced into the molten bath. The product gas formed in the reaction, e.g. a mixture of $CO_2$, $N_2$ and water vapor, passes upwardly in the vessel 12 and is discharged through the product gas outlet duct 18.

According to the present invention, utilizing a tall thin molten salt process vessel having a height "H" to diameter "D" ratio of at least 7:1, and ranging from about 7:1 to about 12:1, the height being measured from the bottom of the vessel to the axis 22 of the product gas duct 18, limits the carry over and the splash of salt particles from the molten salt bath 20 to the top of the vessel or into the product gas leaving the vessel, and facilitates return of salt particles discharged from the molten salt bath 20 and contained in the product gas, to the molten salt body. This feature of the invention thus limits the amount of salt material splashing on the top of the vessel and freezing on the adjacent walls and particularly limits the amount of such particles which freeze at the entrance of ducting 18 to thus avoid buildup of salt deposits and constriction of passage of the product gas from the vessel 12 and into the off-gas ducting. This feature further limits the amount of such salt particles which pass with the product gas through the ducting 18.

Figure 2:
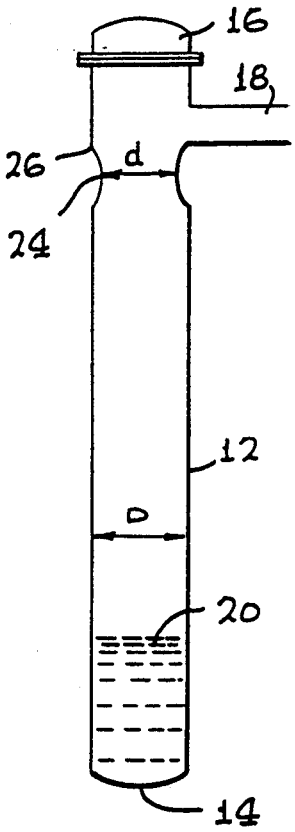
FIG. 2 is a schematic illustration showing the "necked-down" feature incorporated into the molten salt process vessel of FIG. 1.

Now referring to FIG. 2, there is illustrated another feature of the present invention. According to this feature, the diameter "D" of vessel 12 is adjusted adjacent the upper portion of the vessel just below the outlet gas duct 18, as illustrated at 24, to create a "necked-down" region having a smaller diameter "d" followed by the wider diameter region at 26. This "necked-down" region 24 provides a slight increase in product gas velocity as it passes through this region, to aid in maintaining solid particles in the product gas entrained therein so that they are prevented from striking the wall of the vessel and sticking to the wall, but rather such entrained particles of salt pass out the product gas outlet 18 with the product gas. This "necked-down" feature limits the amount of surface at the top of the vessel that the particles or droplets of molten salt see, that is it limits the view that the particles or droplets have at the top of the vessel. Thus such particles see a constricted portion of the diameter because of the necking at 24.

While the "necked-down" region 24 shown in FIG. 2 is located adjacent the upper portion of the vessel 12, the "necked-down" region can be located at a lower level in the vessel 12 and in the hotter region of the vessel interior above the molten salt so that if droplets of molten salt strike the wall at the restricted diameter of the necked portion, such droplets will roll or drain back into the molten salt bath 20. The "necked-down" region 24 is reduced at its narrowest point to a diameter "d" or width equal to or greater than half the diameter or width of the vessel, and ranging from about ½ to about ⅞ of the diameter "D" or width of the vessel 12.

Figure 3:
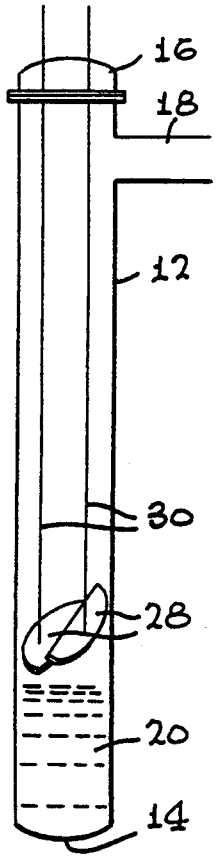
FIG. 3 is a schematic illustration showing the baffle feature incorporated into the molten salt process vessel of FIG. 1.

Yet another feature of the invention is illustrated in FIG. 3 of the drawing. Internal baffles, such as half moon baffles shown at 28 are supported or suspended at 30 in a region within vessel 12 just above the molten salt bath 20, and which is at a temperature at or above the salt melting point. The baffle feature is effective in that the droplets of molten salt splashing upwardly from the salt bath 20 strike or impinge the baffles 28, and being at a temperature above the melting point of the salt, when a molten salt drop splashes it does not freeze on the baffles but rather upon striking the baffles the molten salt droplets splashing upward or entrained in the product gas drip back down into the molten salt 20, whereas in the absence of such baffles such droplets could splash all the way to the top of the vessel, strike the walls thereof and freeze thereon, to ultimately build up a large residue.

Figure 4:
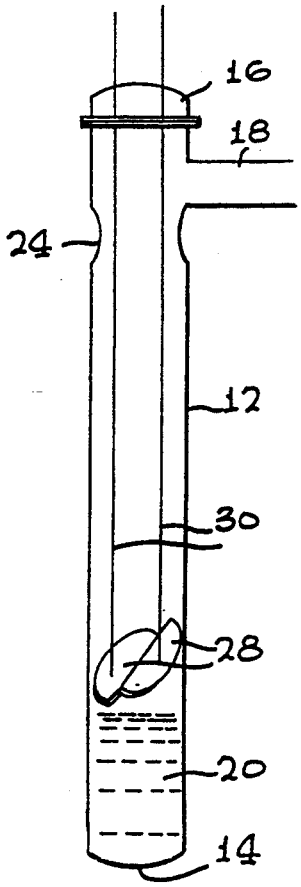
FIG. 4 is a schematic illustration of the improved molten salt process vessel of FIG. 1, including the "necked-down" feature of FIG. 2 and the baffle feature of FIG. 3.

FIG. 4 illustrates the improved molten salt vessel of the invention as illustrated in FIG. 1, and incorporating both the "necked-down" region 24 of FIG. 2 and the suspended baffles 28 of FIG. 3.

Although the molten salt vessel 12 is shown as being cylindrical, the cross section of such vessel can have a polygonal shape such as square or hexagonal. However, under such conditions the ratio of height to width of the vessel at its widest point, should be within the above noted range of about 7:1 to about 12:1.

From the foregoing, it is seen that the invention provides an improved molten salt process vessel for treating hazardous materials such as propellant or explosive waste by incorporating certain mechanical features including a vessel of increased height to diameter, and necking and baffle features, to inhibit splashing of molten salt particles to the top of the vessel, and return such particles to the body of molten salt, thereby also reducing loss thereof, and to reduce buildup of salt deposits within the walls of the vessel to maintain free passage of product gas to the product gas outlet.

It is to be understood that what has been described is merely illustrative of the principles of the invention and that numerous arrangements in accordance with this invention may be devised by one skilled in the art without departing from the spirit and scope thereof.

What is claimed is:

1. An improved molten salt process vessel for treatment of hazardous materials and formation of a product gas, while controlling salt splash which comprises an elongated cylindrical vessel adapted to contain a body of molten salt at the bottom of said vessel for destruction of hazardous material, a laterally extending product gas outlet duct adjacent the upper end of said vessel for removal of product gas, a closure at the top of said vessel, said vessel having a height to diameter ratio measured from the bottom of the vessel to the axis of the product gas outlet duct of at least about 7:1, to facilitate return of salt particles from the molten salt and entrained in the product gas, to the molten salt body, said vessel having a necked down region adjacent the upper portion of said vessel just below said product gas outlet duct to increase product gas velocity through said necked down portion to aid in maintaining solid particles in the product gas entrained therein without striking the wall of the vessel, the diameter of said necked down region being equal to or greater than half the diameter of said vessel, and baffle means provided in said vessel and located above said body of molten salt in the region of the salt melting point whereby liquid droplets of molten salt splashing upward or entrained in the product gas impinge on said baffle means and drip back into said body of molten salt.

2. The molten salt vessel of claim 1, said height to diameter ratio of said vessel ranging from about 7:1 to about 12:1, said baffle means comprising a plurality of half moon baffles suspended in said vessel above said body of molten salt.

3. An improved molten salt process vessel for treatment of hazardous materials and formation of a product gas, while controlling salt splash which comprises an elongated vessel having a single reaction zone and adapted to contain a body of molten salt in said zone at the bottom of said vessel for destruction of hazardous material, a laterally extending product gas outlet duct adjacent the upper end of said vessel for removal of product gas, and a closure at the top of said vessel, said vessel having a height to diameter or height to width ratio measured from the bottom of the vessel to the axis of the product gas outlet duct of at least about 7:1, to facilitate return of salt particles discharged from the molten salt to the molten salt body, said vessel having a necked down region to increase product gas velocity through said necked down region to aid in maintaining solid particles in the product gas entrained therein without striking the wall of the vessel, the diameter or width of said necked down region being equal to or greater than half the diameter or width of said vessel.

4. The molten salt vessel of claim 3, said necked down region having a diameter or width ranging from about one half to about $\frac{7}{8}$ the diameter or width of said vessel.

5. An improved molten salt process vessel for treatment of hazardous materials and formation of a product gas, while controlling salt splash which comprises an elongated vessel having a single reaction zone and adapted to contain a body of molten salt in said zone at the bottom of said vessel for destruction of hazardous material, a laterally extending product gas outlet duct adjacent the upper end of said vessel for removal of product gas, and a closure at the top of said vessel, said vessel having a height to diameter or height to width ratio measured from the bottom of the vessel to the axis of the product gas outlet duct of at least about 7:1, to facilitate return of salt particles discharged from the molten salt to the molten salt body, and including baffle means provided in said vessel and located above said body of molten salt in the region of the salt melting point whereby liquid droplets of molten salt splashing upward or entrained in the product gas impinge on said baffle means and drip back into said body of molten salt, said baffle means comprising a plurality of half moon baffles suspended in said vessel above said body of molten salt.

6. An improved molten salt process vessel for treatment of hazardous materials and formation of a product gas, while controlling salt splash which comprises an elongated vessel having a single reaction zone and adapted to contain a body of molten salt in said zone at the bottom of said vessel for destruction of hazardous material, a laterally extending product gas outlet duct adjacent the upper end of said vessel for removal of product gas, and a closure at the top of said vessel, said vessel having a height to diameter or height to width ratio measured from the bottom of the vessel to the axis of the product gas outlet duct of at least about 7:1, to facilitate return of salt particles discharged from the molten salt to the molten salt body, said height to diameter or height to width ratio of said vessel ranging from about 7:1 to about 12:1, said vessel having a necked down region adjacent the upper portion of said vessel just below said outlet gas duct to increase product gas velocity through said necked down region to aid in maintaining solid particles in the product gas entrained therein without striking the wall of the vessel, said necked down region having a diameter or width ranging from about one half to about $\frac{7}{8}$ the diameter or width of said vessel.

7. An improved molten salt process vessel for treatment of hazardous materials and formation of a product gas, while controlling salt splash which comprises an elongated vessel having a single reaction zone and adapted to contain a body of molten salt in said zone at the bottom of said vessel for destruction of hazardous material, a laterally extending product gas outlet duct adjacent the upper end of said vessel for removal of product gas, and a closure at the top of said vessel, said vessel having a height to diameter or height to with ratio measured from the bottom of the vessel to the axis of the product gas outlet duct of at least about 7:1, to facilitate return of salt particles discharged from the molten salt to the molten salt body, said vessel having a necked down region to increase product gas velocity through said necked down region to aid in maintaining solid particles in the product gas entrained therein without striking the wall of the vessel, and including baffle means provided in said vessel and located above said body of molten salt in the region of the salt melting point whereby liquid droplets of molten salt splashing upward or entrained in the product gas impinge on said baffle means and drip back into said body of molten salt.

8. The molten salt vessel of claim 7, the diameter or width of said necked down region being equal to or greater than half the diameter or width of said vessel, said baffle means comprising a plurality of half moon baffles suspended in said vessel above said body of molten salt.

* * * * *